US005119133A

United States Patent [19]

Swain

[11] Patent Number: 5,119,133

[45] Date of Patent: Jun. 2, 1992

[54] PACKAGED FLEXIBLE PHOTOCONDUCTIVE BELT

[75] Inventor: Eugene A. Swain, Webster, N.Y.

[73] Assignee: Xerox Corporation, Stamford, Conn.

[21] Appl. No.: 398,682

[22] Filed: Aug. 25, 1989

[51] Int. Cl.[5] ..... G03G 15/00; G03G 21/00; B65D 85/66; B65D 85/671

[52] U.S. Cl. ..... 355/212; 206/389

[58] Field of Search ..... 355/211, 212, 213; 206/389, 393, 410

[56] References Cited

U.S. PATENT DOCUMENTS

| | | | |
|---|---|---|---|
| 3,186,543 | 6/1965 | Minick et al. | 206/393 |
| 3,619,050 | 11/1971 | Swanke | 355/212 |
| 3,868,181 | 2/1975 | Tanaka et al. | 355/212 X |
| 3,942,637 | 3/1976 | Glennie | 206/389 |
| 4,162,009 | 7/1979 | Schouten | 206/389 |
| 4,442,789 | 4/1984 | Pirwitz | 118/653 |
| 4,470,690 | 9/1984 | Hoffman | 355/212 |
| 4,566,779 | 1/1986 | Coli et al. | 355/212 |
| 4,860,898 | 8/1989 | Hiro et al. | 355/211 X |

*Primary Examiner*—Fred L. Braun

[57] ABSTRACT

A packaged belt including a single, flexible electrophotographic belt covered with a flexible protective sheet supported by at least three rollers including a hollow first roller having a longitudinal slot parallel to the axis of the first roller which imparts to the first roller a "C" shaped cross section, a lip extending from at least one long edge of the slot, a second roller parallel to and enclosed within the first roller, the second roller having an outside diameter smaller than the inside diameter of the first roller and an outside diameter larger than the maximum size of the opening between the lip and the opposite edge of the slot, a third roller adjacent to and parallel to the exterior of the first roller, the belt covered with the protective sheet having at least a partially flattened region with opposite sides of the belt adjacent each other to form a first loop at one end and a second loop at the other end, the first loop extending around the second roller and the second loop extending around the third roller, the belt extending from the second roller, through the slot, and around at least a portion of the outer periphery of the first roller and ending at the third roller. Processes for preparing the belt package and installing the belt into an electrophotographic imaging machine are also described.

18 Claims, 4 Drawing Sheets

PACKAGED FLEXIBLE PHOTOCONDUCTIVE BELT

This invention relates in general to packaged flexible belts and, more specifically, to packaged flexible photoreceptor belts and process for assembling and using same.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic plate may be in the form of a flexible photoreceptor belt. These flexible belts comprise a substrate having an electrically conductive surface and at least one photoconductive layer. A common flexible photoreceptor belt comprises a substrate, a conductive layer, an optional hole blocking layer, an optional adhesive layer, a charge generating layer, a charge transport layer and, in some embodiments, an anti-curl backing layer. These photoreceptor belts are usually thin and flimsy.

Although excellent toner images may be obtained with flexible belt photoreceptors, it has been found that as more advanced, higher speed electrophotographic copiers, duplicators and printers were developed that utilize large belts, damage to the belts were encountered during storage and installation by the machine operators. Large flexible belt-type photoreceptors are extremely vulnerable to physical and light damage. Because of their size, large belt-type photoreceptors are susceptible to ripples, crinckles, fingerprints, scrapes, scratches, dents, tears, seam stress and the like. The larger the photoreceptor belt, the more prone it is to damage. Moreover, when subjected to elevated temperatures while stored in a convoluted state, sharp bends may become set in the photoreceptor and cause irregularities in the final image during cycling. Further, exposure to room light during belt installation into a copier, duplicator or printer can cause light shock unless rested in the machine for a number of hours following installation.

INFORMATION DISCLOSURE STATEMENT

U.S. Pat. No. 3,942,637 to Glennie, issued Mar. 9, 1976—A packaging configuration for endless nested abrasive belts is described which includes a first core having an axial slot to receive axially within the first core one end of a nest of belts. The belts are wound around the first core and a second core is disposed in the opposite end of the belts. A third core is inserted in the nest of belts and disposed within the loop within the first core to restrict kinking of the belts. A protective wrapping of kraft paper is wound around the outer periphery of the nested belts and a fastening member is positioned around the wrapping to secure the free end to the outer convolution on the first core.

U.S. Pat. No. 4,162,009 to Schouten, issued Jul. 24, 1979—A packaging configuration for an endless fabric material used in paper making machines is described which includes two inner cores at the extreme ends of the endless fabric. One end is inserted into a third, larger core, which has an open longitudinal slot, and is hinged. The remaining fabric is wound around the outside of this larger core. The hinged core is covered with a cushioning material and may be enlarged at the slot edges to prevent creasing of the fabric material. The two inner cores may be mounted on stringing poles during winding to minimize deflection of the cores. If the cores are sufficiently rigid, they are inserted directly in chuck jaws. The ends of the assembled inner cores may be banded together to prevent unrolling. The banded assembly may be wrapped with a protective cover.

U.S. Pat. No. 4,470,690 to Hoffman et al, issued Sep. 11, 1984—A removably mounted electrophotographic belt is described. This belt is mounted on two rollers which are held in a rigid frame. For replacement, the operator grasps a handle attached to the frame and pulls the unit out. One of the rollers is moved to remove tension from the belt to facilitate removal or installation.

U.S. Pat. No. 4,442,789 to Pirwitz, issued Apr. 17, 1984—An electrophotographic imaging system is disclosed which includes a flexible electrophotographic belt supported by two rollers, one of which can be moved to vary tension on the belt.

U.S. Pat. No. 4,566,779 to Coli et al, issued Jan. 28, 1986—A replaceable process unit is described which includes an endless belt photoconductive member and its supporting structure, in addition to toner supply and belt drive means.

SUMMARY OF THE INVENTION

It is, therefore, an object of the present invention to provide an improved packaged flexible photoreceptor belt and method of preparing and using same which overcome the above-noted disadvantages.

It is yet another object of the present invention to provide an improved packaged flexible photoreceptor belt which protects the sensitive surface of a photoreceptor belt during transportation and storage.

It is still another object of the present invention to provide an improved process for packaging a flexible photoreceptor belt while avoiding damage to its sensitive surface.

It is another object of the present invention to provide an improved process for installing a flexible photoreceptor belt into an electrophotographic imaging device while avoiding damage to its sensitive surface.

It is yet another object of the present invention to provide an improved packaged flexible photoreceptor belt which can be easily installed into an electrophotographic imaging device by an untrained person.

The foregoing objects and others are accomplished in accordance with this invention by providing a packaged belt comprising a single, flexible electrophotographic belt covered with a flexible protective sheet supported by at least three rollers comprising a hollow first roller having a longitudinal slot parallel to the axis of the first roller which imparts to the first roller a "C" shaped cross section, a lip extending from at least one long edge of the slot, a second roller parallel to and enclosed within the first roller, the second roller having an outside diameter smaller than the inside diameter of the first roller and an outside diameter larger than the maximum size of the opening between the lip and the opposite edge of the slot, a third roller adjacent to and parallel to the exterior of the first roller, the belt covered with the protective sheet having at least a partially flattened region with opposite sides of the belt adjacent each other to form a first loop at one end and a second loop at the other end, the first loop extending around the second roller and the second loop extending around the third roller, the belt extending from the second roller, through the slot, and around at least a portion of the outer periphery of the first roller and ending at the third roller.

The flexible electrophotographic belt covered with the protective sheet may be packaged by bringing opposite sides of the belt adjacent each other to form at least a partially flattened belt with a first loop at one end and a second loop at the other end, sliding the first roller over the first loop with the partially flattened belt sliding through the longitudinal slot, providing a second roller having an outside diameter that is less than the inside diameter of the first roller and an outside diameter larger than the width of the slot, sliding the second roller into the first loop within the second roller whereby the second roller is enclosed by and coaxial with the first roller, sliding a third roller into the second loop, rotating the second roller to wind the belt around the second roller, and securing the belt, the first roller, the second roller and the third roller together.

The packaged belt is installed into an electrophotographic imaging apparatus by providing an electrostatographic imaging apparatus comprising at least two photoreceptor belt support rollers, at least one of the photoreceptor belt support rollers being movable relative to the other support roller to apply tension or release tension on a used belt mounted on the support rollers, moving at least one of the support rollers to release tension on the used belt, removing the used belt from the support rollers, temporarily supporting the second roller adjacent one of the support rollers, moving the third roller toward the other support roller to unroll the fresh belt, sliding the fresh belt onto the support rollers, removing the protective sheet and moving at least one of the support rollers to apply tension to the fresh belt.

The packaged electrophotographic belt of this invention is particularly suitable for belts having a large circumference which renders the belt difficult to package, store, transport and install. For example, belts having an outer circumference of about 40 inches (102 cm) are relatively simple for an operator to install. However, belts having larger circumferences such as 70 inches (178 cm), 80 inches (203 cm) or greater which extend to or beyond the maximum reach of the outstretched arms of an operator become almost impossible to install without damaging the belt. Generally, the large belts employed in this invention are very thin and flexible, for example, having a thickness of about 0.005 inch (127 mm). Thus, a belt having a circumference less than about 100 cm in circumference can usually be handled manually with, perhaps slight difficulty, but belts larger than about 100 cm can be extremely difficult for a single person to handle and for belts with circumferences greater than about 150 cm, acceptable handling becomes impossible.

Electrophotographic flexible belt imaging members are well known in the art. Typical electrophotographic flexible belt imaging members usually comprise a flexible substrate having an electrically conductive surface and at least one photoconductive layer.

Electrophotographic flexible belt imaging members may be prepared by various suitable techniques. Typically, a flexible substrate is provided having an electrically conductive surface. At least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is thereafter formed on the charge generation layer. In other embodiments, the charge generation layer overlies the charge transport layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar, available from E. I. du Pont de Nemours & Co. or Melinex available from ICI.

The thickness of the substrate layer depends on numerous factors, including beam strength and economical considerations, and thus this layer for a flexible belt may be of substantial thickness, for example, about 125 micrometers, or of a minimum thickness less than about 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

If a separate electrically conductive layer is employed, the conductive layer may vary in thickness over substantially wide ranges depending on the optical transparency and degree of flexibility desired for the electrophotographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. A typical electrical conductivity for conductive layers for electrophotographic imaging members in slow speed copiers is about $10^2$ to $10^3$ ohms/square.

After formation of an electrically conductive surface, a hole blocking layer may be applied. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)-titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra-red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

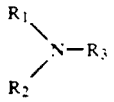

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder in a suitable solvent may be employed in the flexible photoreceptor. Typical inactive resin binders soluble in methylene chloride include polycarbonate resin, polyvinylcarbazole, polyester, polyarylate, polyacrylate, polyether, polysulfone, and the like. Molecular weights can vary, for example, from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and comprise usually comprise conductive particles dispersed in a film forming binder.

Instead of a multi-layered photoconductive member comprising the charge generation layer and charge transport layer, one may use a single layer photoreceptor comprising photoconductive particles dispersed in a film forming binder. These single layered photoreceptors are well known in the art.

An overcoat layer may optionally be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers. The thickness of anti-curl backing layers should be sufficient to substantially balance the total forces of the layer or layers on the opposite side of the supporting substrate layer. The total forces are substantially balanced when the belt has no noticeable tendency to curl after all the layers are dried. For example, for an electrophotographic imaging member in which the bulk of the coating thickness on the photoreceptor side of the imaging member is a transport layer containing predominantly polycarbonate resin and having a thickness of about 24 micrometers on a Mylar substrate having a thickness of about 76 micrometers, sufficient balance of forces can be achieved with a 13.5 micrometers thick anti-curl layer containing about 99 percent by weight polycarbonate resin, about 1 percent by weight polyester and between about 5 and about 20 percent of coupling agent treated crystalline particles. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors. Thicknesses between about 85 micrometers and about 145 are preferred and optimum results are achieved with a photoreceptor having a thickness of between about 90 micrometers and about 135 micrometers. Thin highly flexible belts can be bent more sharply than thick less flexible belts and, therefore, are more resistant to creep.

The packaged belt of this invention comprises a flexible belt supported by a plurality of support rollers comprising a single, flexible electrophotographic belt covered with a flexible protective sheet supported by at least three rollers comprising a hollow first roller having a longitudinal slot parallel to the axis of the first roller which imparts to the first roller a "C" shaped cross section, a lip extending from at least one long edge of the slot, a second roller parallel to and enclosed within the first roller, the second roller having an outside diameter smaller than the inside diameter of the first roller and an outside diameter larger than the maximum size of the opening between the lip and the opposite edge of the slot, a third roller adjacent to and parallel to the exterior of the first roller, the belt covered with the protective sheet having at least a partially flattened region with opposite sides of the belt adjacent each other to form a first loop at one end and a second loop at the other end, the first loop extending around the second roller and the second loop extending around the third roller, the belt extending from the second roller, through the slot, and around at least a portion of the outer periphery of the first roller and ending at the third roller.

The hollow first roller has a longitudinal slot parallel to the axis of the first roller. This slot imparts to the first roller a "C-shaped" cross section. The sides of the slot in the C-shaped roller should be parallel to each other and to the axis of the first roller to ensure alignment during winding and to provide uniform tension on the belt. The width of the slot is measured from one slot edge to the other slot edge. Where one slot edge extends into a curved lip, that slot edge is defined as the point where the curve of the lip intersects the curve of the C-shaped first roller. This point lies along a line parallel to the axis of the C-shaped first roller.

A curved lip on at least one of the edges of the slot is desirable to avoid a set to form in the belt due to creep. Creep can be aggravated by tension and/or exposure to elevated temperatures. The lip may be a thin curved arcuate shell or a solid bead or other suitable means having an outer surface with an arcuate cross section (viewed in a direction parallel to the axis of the first roller) may be substituted for the lip. The lip may be located on both or one side of one or both edges of the slot. The arcuate cross section of the lip should have a relatively large radius of curvature. The arcuate shape need not be circular but of some other suitable curved shape that supports the belt as it projects outwardly from the second roller, through the slot and and around the outer periphery of the first roller so that the sharp bends in the belt are avoided and permanent sets are avoided. Generally, a radius of curvature at any point along the curve of the lip should be at least about $\frac{3}{8}$ inch (9 mm) to reduce the likelihood that an undesirable set will form in the belt. In other words, the configuration of the belt is maintained by the rollers and lip so that the entire packaged belt is free of any bends having a radius of curvature less than about 9 mm. If the lip extends from the slot edge into the interior of the second tube, such extension should leave sufficient room for insertion of the second tube. The width of the lip depends on the size of the first and second rollers, e.g. for smaller rollers, the width of the lip may be smaller. In any event, the width should be sufficient to maintain the belt in the transition area between the second roller and the exterior of the first roller free of any bends having a radius of curvature less than about 9 mm. A lip on each of the slot edges may be particularly desirable for very large diameter first rollers to ensure that the belt is maintained free of any bends having a radius of curvature of less than about $\frac{3}{8}$ inch (9 mm).

The portion of the lip surface which contacts the belt is preferably covered with a cushioning material. Typical cushioning materials include flock, elastomers, sponge rubber, and the like. These cushioning materials are preferably soft and compliant to reduce and spread pressure on the contacting surface of the belt when it is in a wound condition. The maximum size of the opening between the lip and the opposite edge of the slot of the C-shaped support roller must be smaller than the outer diameter of the second support roller to prevent the second support roller from passing through the slot. The minimum size of the opening between the lip and the opposite edge of the slot should also be sufficiently large to allow the pinched portion photoreceptor web and protective cover sheet to freely slide through the slot with minimal friction. Also, the walls of the first tube should be sufficiently stiff to prevent widening of the slot to the extent that the second tube passes through the slot during winding and unwinding of the photoreceptor web. Passage of the second tube through the slot will preclude the capability of winding and unwinding of the photoreceptor web.

The inner diameter of the C-shaped support roller must be larger than the outer diameter of the second support roller to permit insertion of the second support roller into the interior of the C-shaped support roller. The radius of curvature of the C-shaped roller should be at least about 10 mm to prevent a "set" from forming on the photoreceptor during storage at elevated temperatures.

The radius of curvature of the outer surface of the inner second support roller and the third support roller should be sufficient to prevent an undesirable crease or permanent set to form in the belt during storage and transportation. The size depends on the creep parameters of the belt material as well as the storage and transportation temperatures contemplated. Thus, the radius of curvature may be as little as about 9 mm when moderate temperatures and creep resistant materials are utilized. For more sensitive materials exposed to elevated temperatures, the radius of curvature of the outer surface of the inner second support roller and the third support roller may preferably be larger, such as about 0.75 inch (12.7 mm) or larger. Because the configuration of the photoreceptor package of this invention does not allow the photoreceptor to bend around a small radius, cracking of the photoreceptor layers is prevented and severe "set" during long term storage at various temperature extremes is avoided.

The cross-section of the support rollers may be of any suitable shape. Thus, the cross section may have a round, octagonal, square, elliptical or other suitable shape. Generally, abrupt changes in the outer surface should be avoided. Thus, for example, a cross section that a generally square shape should have rounded corners to avoid sharp bends that would form creases or sets in the belt. Roller surfaces with a cross section having a radius of curvature of less than about 9 mm tends to contribute to the formation of creases or sets in the belt. The cross sectional shape of the peripheral surface of the support rollers should be such that a radius of curvature of less than about 9 mm is avoided at any location of the belt in the package. In other words, the radius of curvature of any curve in the packaged photoreceptor web is maintained at a value of at least about 9 mm. The second and third support rollers may be in the form of hollow tubes, solid cylinders, or other suitable configuration having a smooth outer surface. Generally, hollow rollers are preferred because of economic and weight advantages. Solid cylinders are heavy and more expensive. One or both ends of hollow support rollers may be open or sealed. The overall shape selected for the rollers will depend on the means selected for supporting the rollers during winding of the photoreceptor belt onto the rollers and unwinding of the photoreceptor belt from the rollers. For example, cantilevered rods can be used to support hollow rollers having at least one open end during winding and unwinding. Rollers with closed ends may be supported during winding and unwinding of the belt by any suitable means such as a rotatable elastomeric cup fastened to a rigid support, the open end of the cup facing away from the support. The inside diameter of the cup should preferably be slightly smaller than the outside diameter of the end of the support roller so that the support roller fits snugly within the cup for a friction fit. When a support roller is supported by means that grip the outer surface of one end of the roller, that end of the roller should extend beyond the edge of the photoreceptor belt. If desired, rollers with a closed end may be configured to include a shaft extending from the closed end. The shaft can be inserted into a suitable cavity in a support means to support the roller in a cantilevered attitude for belt winding or unwinding.

Any suitable self supporting material may be utilized for the rollers. Typical materials include thermoplastic resins, thermosetting plastics, pasteboard, composite materials, paperboard, and the like. Thermoplastic materials are preferred for simplicity of fabrication, e.g. formation by extrusion. Although the C-shaped roller, second roller and third roller may comprise disposable material, reuseable materials may be employed instead. All the rollers should be free of loose particulate material. The second and third support rollers may merely be simple tubes or comprise sophisticated shapes with features such as internal partitions containing offset support rod holes to minimize wobble of the "C" shaped roller during rolling or unrolling of the second support roller on a support rod. Moreover, the second and third support rollers may be spoked or comprise any other suitable configuration.

A thin protective cover sheet is positioned over the outer surface of the electrophotographic belt to provide additional protection from contact with various surfaces and, in some embodiments, from exposure to light. Any suitable flexible protective covering sheet may be utilized. The sheet should be chemically inert and free of loose particulate materials such as lint, fibers, dust dirt and the like. The surface of the protective sheet contact with the photoreceptor should also be sufficiently soft so that it conforms to and does not scratch the surface of the photoreceptor. The protective sheet may be transparent or opaque to light. Opaque sheets are preferred to minimize exposure of the photoreceptor to light during installation in an electrostatographic copier/duplicator or printer. Opaque protective covers are particularly desirable for highly sensitive electrostatographic imaging members that are utilized in high speed duplicators and printers. Exposure of sensitive belts to light can, under some circumstances, cause fatigue in the photoreceptor. If desired, the protective sheet may be in the form of an endless belt that surrounds the electrophotographic imaging belt. Generally, the inner circumference of the protective endless belt should closely match the outer circumference of the electrophotographic belt to avoid bubbles that might cause ripples or bends in the electrophotographic belt after the belt is wound around the rollers. A protective cut sheet or web can be used instead of an endless belt. When a protective cut web is employed, the web may be wrapped around the photoreceptor belt and the ends of the web overlapped and fastened by suitable means such as an adhesive tape. The protective sheet may be made out of any suitable material free of loose particulate materials. Typical sheet materials include paper, cloth, plastic, non-woven fabric, and the like. The sheet is placed on the sensitive outside surface of the belt. Preferably, the protective sheet is disposable.

If the protective cover is not opaque, it may be desirable to drape a black cloth over the entire duplicator/copier or printer during installation of the electrostatographic belt to protect the belt from exposure to unwanted ambient radiation. Exposure of sensitive belts to light can, under some circumstances, cause fatigue in the photoreceptor.

Generally, the photoreceptor belt may be installed in its package by mounting the second and third rollers on suitable support means such as cantilevered rods that are movable relative to each other. The cantilevered rods facilitate winding of the photoreceptor belt onto the rollers and removal of the wound belt and rollers from the rods. If rods or other suitable support means are utilized for the interior of hollow support rollers during packaging of the photoreceptor or during mounting in a machine, the rods need not be centered in the rollers.

In one embodiment for packaging the photoreceptor belt, two rods may be positioned parallel to and sufficiently close to each other to allow the belt to be mounted on hollow support rollers supported by the rods while the belt is slack. A protective cover is thereafter placed around the belt. Belt shaped protective covers or other cut webs may be used. One or both of the rods may thereafter be moved away from the other to remove most of the slack. The photoreceptor belt may thereafter be compressed adjacent to one of the support rollers so that the inner surfaces of the belt are in contact with or close to each other. Such compression may be accomplished by hand or by the use of parallel rods which sandwich both sides of the protective cover and photoreceptor belt between the rods. With the belt compressed, the C-shaped roller may be coaxially slipped over one end of the second support roller with the compressed portion of the covered belt being slid through along the slot of the C-shaped roller.

In another embodiment, the steps described in the preceding paragraph are repeated except that one loop of the belt is directly supported by a rod rather than by the second roller on a rod. After the pinched portion of the belt is slid through along the slot of the C-shaped roller, the second roller is slipped through the belt loop within the interior of the C-shaped roller.

The C-shaped roller is thereafter rotated to wind the photoreceptor belt around the outer periphery of the C-shaped roller. Rotation of the C-shaped roller may be effected by hand or by an automated device such as a rotatable, cantilevered vacuum platen having an arcuate surface which closely matches the inner arcuate shape of the large C-shaped roller. The platen is inserted into the space between the second roller and the C-shaped roller with the vacuum holes on the arcuate surface of the platen facing the inside surface of the C-shaped roller. Once the platen is inserted inside the C-shaped roller, a vacuum may be applied to the platen through a conventional rotary vacuum coupling to allow the platen to grip the interior of the C-shaped roller. Rotation of the platen causes the C-shaped roller to rotate to wind the belt around the C-shaped roller. The platen may be rotated by hand or by any suitable conventional device such as an electric motor. Any suitable means such as a weighted cable and pulley arrangement may be secured to one or both ends of the third support roller to bias the third support roller in a direction away from the C-shaped roller to maintain the photoreceptor belt under tension during winding.

The belt may be wrapped around the outer circumference of the C-shaped roller less than one complete wrap or a plurality of wraps. For belts having a very large circumference, the number of wraps around the the first roller can be quite high if the circumference of first roller is small relative to the circumference of the belt.

Prior to removal of the wound belt assembly from the rods, the assembly of rollers may be held together by clips (for hollow rollers) or bands. If the ends of the support rollers extend beyond the edges of the photoreceptor belt, the bands may be wrapped around the extended portion of the rollers instead of or in addition to being wrapped around the wound photoreceptor belt and protective cover. Any suitable band configuration may be used. Typical bands include adhesive tape, paper strips, Velcro bands, elastic bands of rubber or other elastomer, and the like. These bands should not produce undue pressure against the surface of the photoreceptor through the protective cover. After the winding and fastening or banding steps, the assembly may be sealed in a moisture proof pouch or other suitable outer cover and thereafter protected in a sturdy enclosure such as a cardboard box.

Generally, belt-type electrophotographic imaging machines utilize at least two support rollers to support the belt. During removal or mounting of a belt type photoreceptor, at least one roller is moved closer to one or more of the other rollers to provide slack so that the photoreceptor belt can be readily installed or removed. To install a fresh belt from the package of this invention, the wound assembly is removed from the outer packaging and the clip or band utilized to hold the rollers together is removed. The second support roller within the interior of the C-shaped roller is thereafter mounted on a suitable support which, for example, can be a rod cantilevered from the end of the shaft of a photoreceptor support roll of the electrophotographic imaging machine. Alternatively, the cantilevered support means may be supported from some other convenient part of the imaging machine adjacent to the roller. After the second support roller within the C-shaped roller is mounted on a suitable support cantilevered from the machine, the third support roller is moved away from the C-shaped roller to unroll the photoreceptor belt and protective cover from the C-shaped roller. If desired, subsequent to unrolling of the photoreceptor belt and protective cover, the third support roller may be temporarily supported by a cantilevered rod which may, for example, be inserted through the third support roller and into a receptacle at the end of the shaft of another photoreceptor support roll of the electrophotographic imaging machine. The C-shaped roller is thereafter removed from around the second roller by axially sliding the C-shaped roller away from the machine. The fresh photoreceptor belt and protective cover may then be slid from the second and third support rollers of the photoreceptor package onto the support rollers of the electrophotographic imaging machine. The protective cover is removed and at least one of the support rollers of the electrophotographic imaging machine is moved to apply tension to the photoreceptor belt.

The hardware for mounting the belt is preferably stored with the machine for reuse. Any suitable means may be utilized to hold the second support roller in position adjacent the end of one of the support rollers of the machine while the third roller is pulled away from the C-shaped roller to unwind the belt from the C-shaped roller. If cantilevered rods are utilized, they may be of any suitable diameter that will fit within the interior of the hollow support rollers. The rods may have a diameter preferably close to but smaller than the inside diameter of the hollow support rollers. The support rods may be screwed into threaded holes in the machine, such as at the end of the shaft of at least one of the machine support rollers. The hole need not be threaded but may be of sufficient diameter to support a temporary rod that is merely slid into the hole. Moreover, the rod need not extend the full length of the roller which it supports. Thus, a small short stub-type knob or extension may be mounted at the end of one of the machine support roller shaft to support one end of the second or third roller. If desired, a knob having a section that press fits into the interior of one end of the second roller may be utilized so that the operator installing the photoreceptor may grip the exposed portion of the knob and manually provide braking during the unwinding process. Generally, unwinding is effected by any suitable technique such as gripping the outside of the protective sheet and photoreceptor loop around the third roller and moving the gripped third roller away from the C-shaped first roller. Alternatively, a rod may be inserted into the third roller and hand held at one end to allow the third roller to be pulled away from the C-shaped roller.

BRIEF DESCRIPTION OF THE DRAWINGS

A more complete understanding of the process of the present invention can be obtained by reference to the accompanying drawings wherein.

Figure 1:
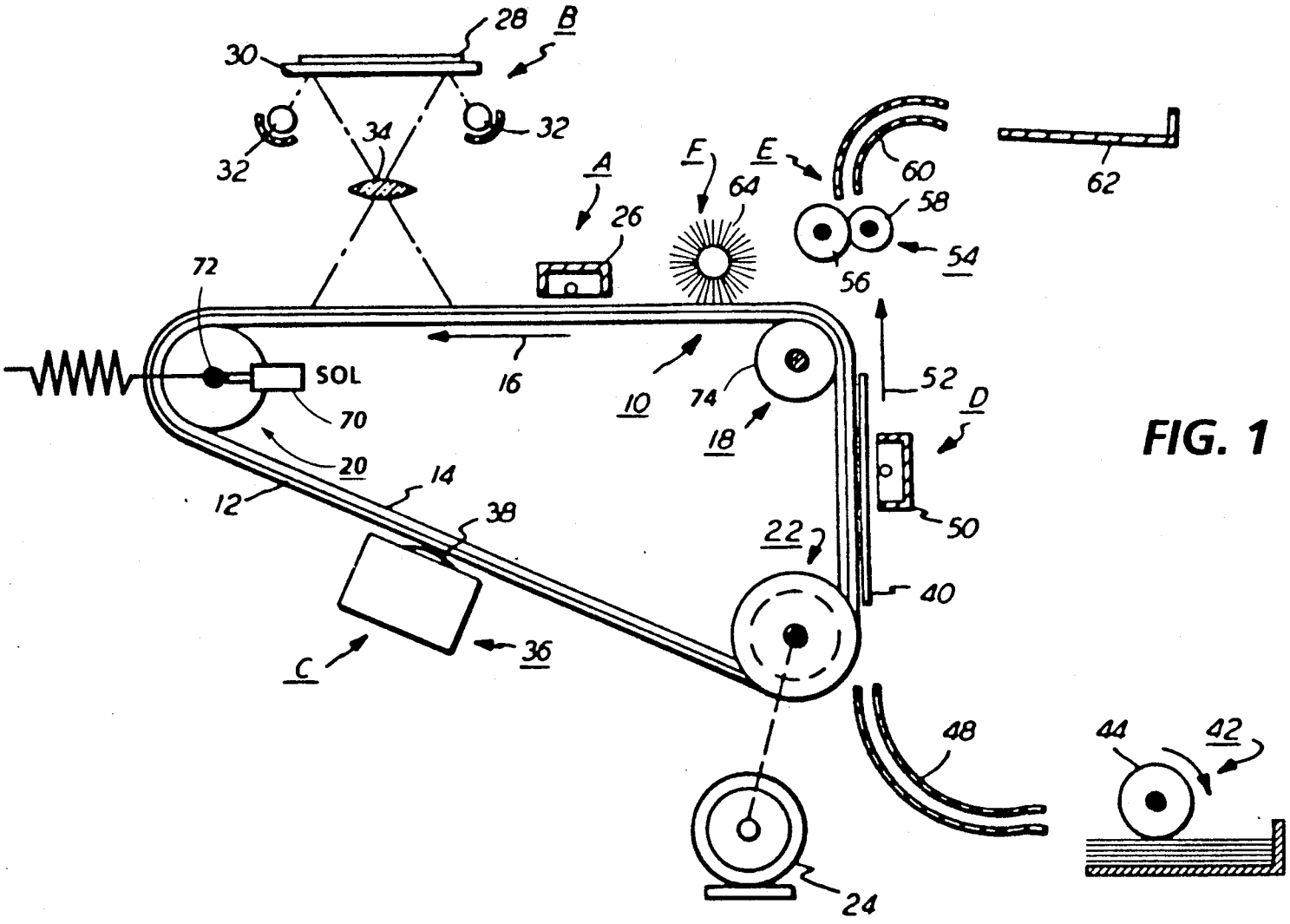
FIG. 1 is a schematic elevational view depicting an illustrative electrophotographic printing machine.

These figures merely schematically illustrate the invention and are not intended to indicate relative size and dimensions of actual components thereof.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements.

FIG. 1 schematically depicts the various elements of an illustrative electrophotographic printing machine incorporating a photoreceptor belt therein. It will become evident from the following discussion that the photoreceptor belt is equally well suited for use in a wide variety of electrostatographic printing machines or other types of devices that form electrophotographic images, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

DETAILED DESCRIPTION OF THE DRAWINGS

Referring to FIG. 1, the electrophotographic printing machine employs a flexible belt 10 having a photoconductive surface 12 deposited on a substrate 14 having a conductive surface. The photoconductive surface 12 may comprise one or more photoconductive layers. The conductive surface of substrate 14 is electrically grounded by suitable means not shown. Belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs 25 resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face down upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28. Thereafter, belt 10 advances the electrostatic latent image recorded on photoconductive surface 12 to development station C.

At development station C, a magnetic brush development system, indicated generally by the reference numeral 36, transports a developer mixture of carrier granules and toner particles into contact with the electrostatic latent image recorded on photoconductive surface 12. Magnetic brush development system 36 includes a magnetic brush developer roller 38. Magnetic brush developer roller 38 forms a brush of carrier granules and toner particles. The toner particles are attracted from the carrier granules to the electrostatic latent image forming a toner powder image on photoconductive surface 12 of belt 10.

After development, belt 10 advances the toner powder image to transfer station D. At transfer station D, a sheet of support material is moved into contact with the toner powder image. The sheet of support material is advanced to transfer station D by a sheet feeding apparatus, indicated generally by the reference numeral 42. Sheet feeding apparatus 42 includes a feed roller 44 contacting the uppermost sheet of a stack of sheets 46. Feed roller 44 rotates to advance the uppermost sheet from stack 46 into chute 48. Chute 48 directs the advancing sheet of support material into contact with photoconductive surface 12 of belt 10 in a timed sequence so that the toner powder image developed thereon contacts the advancing sheet of support material 40 at transfer station D.

Transfer station D includes corona generating device 50 which sprays ions onto the backside of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Fuser assembly 54 includes a heated fuser roll 56 and a back-up roll 58. Sheet 40 passes between fuser roll 56 and back-up roll 58 with the toner powder image contacting fuser roll 56. In this manner, the toner powder image is permanently affixed to sheet 40. After fusing, chute 60 guides the advancing sheet to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 64 in contact with photoconductive surface 12. The pre-clean corona generating device neutralizes the charge attracting the particles to the photoconductive surface. These particles are cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

When photoconductive belt 10 is to be removed from or installed in the electrophotographic printing machine, sufficient slack in belt 10 may be achieved by activation of solenoid 70 to move shaft 72 which supports tension roller 20 in the direction of shaft 74 which supports stripping roller 18. A machine operator may then slide belt 10 in a direction parallel to the axis of tension roller 20, idler roller 18 and drive roller 22 towards the operator for removal of the belt 10 from the printing machine.

It is believed that the foregoing description is sufficient for purposes of the present application to illustrate the general operation of an illustrative electrophotographic printing machine incorporating the features of the present invention therein.

Figure 2:
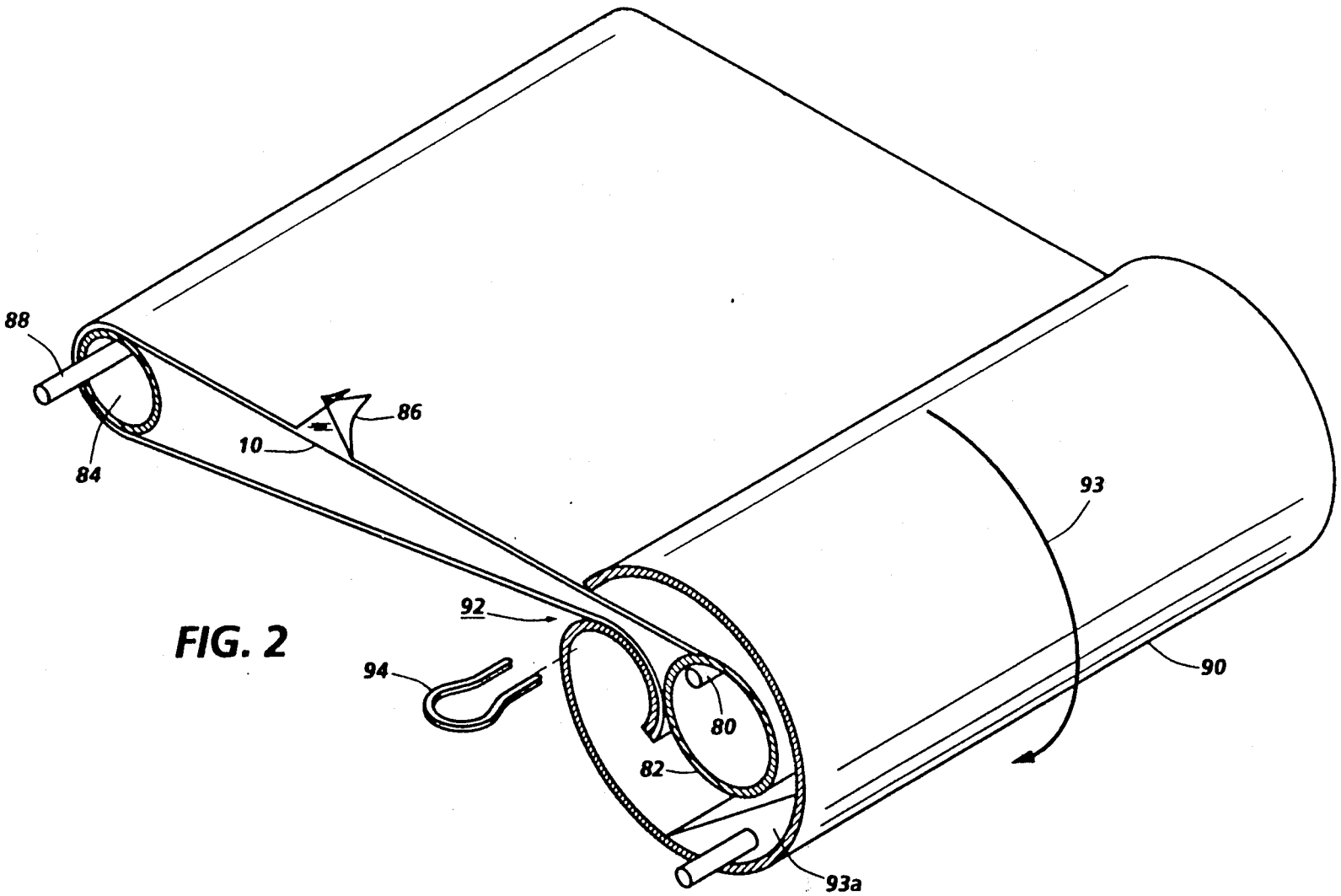
FIG. 2 is a schematic elevational view depicting an illustrative packaged photoreceptor incorporating the features of the present invention therein.

Referring to FIG. 2, a fresh photoreceptor belt may be packaged by supporting hollow second roller 80 on a cantilevered rod 82 having its fixed end fastened to a suitable support (not shown) and sliding photoreceptor belt 10 onto second roller 80. A hollow third roller 84 may thereafter be inserted into the belt loop at end farthest from the location of second roller 80. A protective sheet 86 in the shape of a loop having a slightly larger interior circumference than the exterior circumference of the photoreceptor belt 10 is then slid over the exterior of belt 10. Rod 88 is inserted into the interior of hollow third roller 84. The opposite sides of photoreceptor belt 10 immediately adjacent second roller 80 are gently pinched together and C-shaped hollow first roller 90 is then slid over second roller 80 with the pinched portion of the photoreceptor being slid along slot 92 of C-shaped hollow first roller 90. Slot 92 has a width that is less than the outside diameter of second roller 80 to ensure retention of roller 80 within the interior of C-shaped hollow first roller 90. C-shaped hollow first roller 90 is thereafter rotated in the direction indicated by arrow 93 by a vacuum platen **93*a* to wind belt 10 around the outer periphery of C-shaped hollow first roller 90 until hollow third roller 84 is adjacent to C-shaped hollow first roller 90. Vacuum platen 93*a* has a circle segment shaped cross section. The curved surface of platen 93*a* contains a plurality of holes (not shown) which are placed against the interior surface of C-shaped hollow first roller 90 prior to connecting vacuum platen 93*a* to a source of a partial vacuum. Vacuum platen 93*a* is connected to the source of a partial vacuum through a suitable conventional rotary vacuum coupling and valve (not shown). Application of a partial vacuum to vacuum platen 93*a* allows platen 93*a* to grip the C-shaped hollow first roller 90. The vacuum platen 93*a* is rotated with the aid of a conventional electric motor (not shown) or by hand. The assembled rollers 80, 84 and 90 may thereafter be held together by a suitable means such as a "U-shaped" clip 94**.

Figure 3:
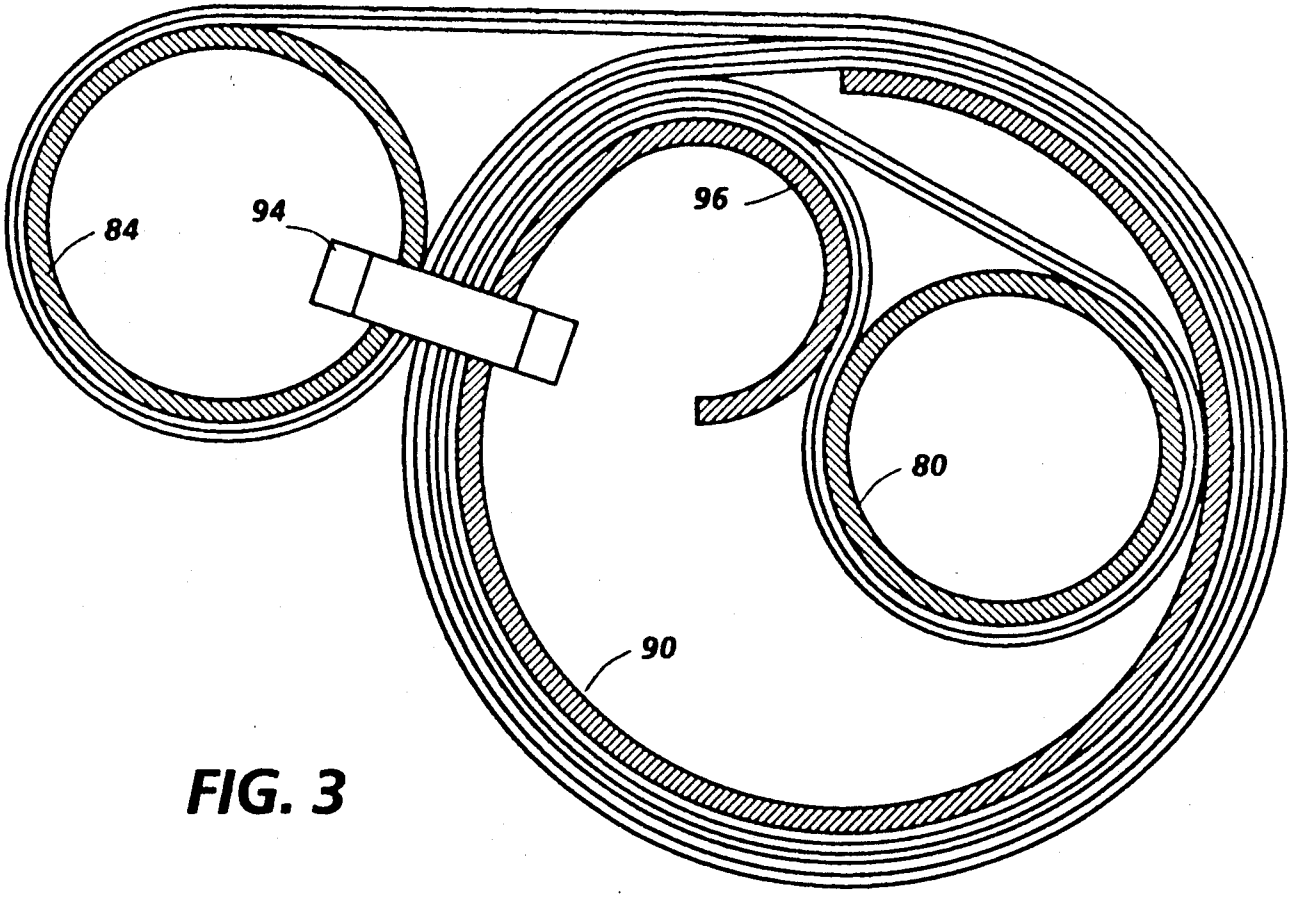
FIG. 3 is a schematic isometric view illustrating the assembling of a packaged photoreceptor incorporating the features of the present invention therein.

As shown in FIG. 3, the assembled rollers 80, 84 and 90 are held together by U-shaped spring clips 94 located at each end of third roller 84 and C-shaped hollow first roller 90. Alternatively, or in combination with the clip 94, a band or tape (not shown) may be wrapped around the outer periphery of the assembled photoreceptor package or around extensions of rollers 80, 84 and 90 to hold the assembled rollers together. The cross section of lip 96 has a large radius of curvature which prevents any undesirable set from forming in the section of the belt 10 which extends from hollow second roller 80 to the exterior of C-shaped hollow first roller 90. The assembled rollers and photoreceptor may thereafter be inserted into a suitable protective envelope such as a hermetically sealed pouch.

Figure 4:
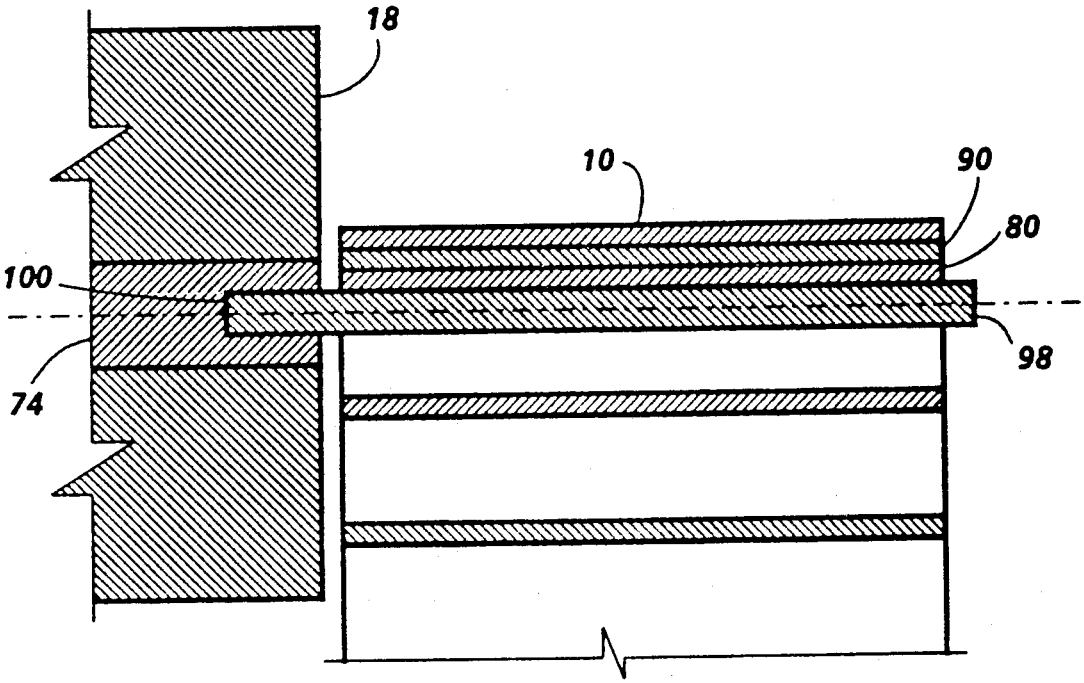
FIG. 4 is a fragmentary, plan view depicting the wrapping or unwrapping of a packaged photoreceptor incorporating the features of the present invention therein.

Referring again to to FIG. 1, spring loaded tension roller 20 is moved towards idler roller 18 and/or drive roller 22 by activation of solenoid 70 to remove tension from photoreceptor belt 10. The old belt 10 may thereafter be slid by an operator in a direction parallel to the axis of tension roller 20, idler roller 18 and drive roller 22 towards the operator for removal of the belt to from the printing machine. To install a fresh belt 10, a suitable support such as cantilevered rod 98 shown in FIG. 4 may be partially inserted into a drilled hole 100 at the end of shaft 74 which supports stripping roller 18. Although support rods that merely slide into drilled holes in the ends of the shafts of tension roller 20 and idler roller 18 are preferred for simplicity, the drilled holes at one end of the shafts and one end of the support rods may be threaded to allow the rods to be screwed into the holes at the ends of the shafts. Rod 98 is cantilevered outwardly from the end of shaft 74. In this embodiment, rod 98 has a relatively small diameter compared to the inside diameter of hollow second roller 80. After it is installed into the drilled hole at the end of shaft 74, the exposed portion of the rod 98 may be longer than the length of hollow second roller 80 or it can be shorter so long as the length is sufficient to support hollow second roller 80 during the installation of fresh photoreceptor belt 10. An assembled photoreceptor package (see FIG. 3) containing a fresh photoreceptor belt 10 is removed from an outer packaging pouch (not shown) and hollow second roller 80 is then slid by an operator onto the shaft 74 until one end of hollow second roller 80 is in contact or closely adjacent to the end of stripping roller 18. With rod 98 supporting second roller 80, the operator grips the end of a second rod and inserts the free end (not shown but similar to rod 88 shown in FIG. 2) into the interior of hollow third roller 84 and removes the U-shaped clips 94. The operator then moves the second rod toward shaft 72 of tension roller 20 to unwind the fresh belt from C-shaped hollow first roller 90. The second rod is thereafter inserted into a drilled hole (not shown but identical to drilled hole 100 at the end of shaft 74) located at the end of shaft 72. The operator removes C-shaped hollow first roller 90 from fresh photoreceptor belt 10 (still covered with protective sheet 86) and lifts and slides photoreceptor 10 and protective sheet 86 from second roller 80 and third roller 84 onto tension roller 20 and idler roller 18 and also around drive roller 22. After fresh photoreceptor belt 10 is slid into operating position and aligned with tension roller 20, stripping roller 18 and drive roller 22, protective sheet 86 is removed from the surface of photoreceptor 10 by sliding the sheet towards the operator. Solenoid 70 is then inactivated to allow the spring biased tension roller 20 to move away from stripping roller 18 and drive roller 22 to apply tension to fresh belt 10. Second roller 80 and rod 98 are removed from shaft 74 and third roller 84 and the second rod are removed from the shaft 72.

Figure 5:
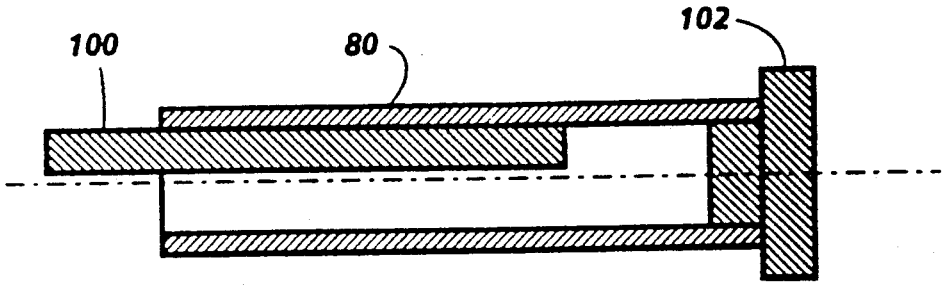
FIG. 5 is a fragmentary, plan view showing a means to brake a second roller.

During the unrolling of the fresh photoreceptor belt 10, resistance to unrolling may be desirable so that the photoreceptor is under tension during the unrolling process. Tension may be applied by any suitable technique. For example, the operator may merely insert two or more fingers into the open free end of second roller 80 to achieve drag during rolling. Alternatively, hollow second roller 80 may extend beyond the edge of the fresh photoreceptor belt 10 so that the operator may grip the exposed exterior of second roller 80. If desired, an operator may brake rotation of second roller 80 or C-shaped hollow first roller 90 while belt 10 is unwound from C-shaped hollow first roller 90 during the installation process by loosely gripping a knob 102 (illustrated in FIG. 5 with belt 10 and C-shaped hollow first roller 90 not shown). Knob 102 is retained in the end of second roller 80 by a friction fit.

Other suitable means for temporarily supporting second roller 80 and third roller 84 may be used. For example, the ends of shafts 74 and 72 may containing large diameter stubs that extend beyond the ends of idler roller 18 and tension roller 20, respectively, so that the ends of hollow second roller 80 and third roller 84 may be supported by the stubs during installation of fresh photoreceptor 10. The stubs would grip the interior of the ends of hollow second roller 80 and third roller 84 in a manner identical to that of knob 102 shown in FIG. 5. These extensions may be a permanent part of the shafts or may be removable. Modified embodiments of the stubs include free wheeling stubs that may rotate independently of the shaft. In still another embodiment, the stubs may be removable and contain an adjustable drag or clutch means similar to those commonly employed in the spools of open faced spinning reels used for fishing.

The configuration of the packaged belt of this invention greatly improves belt handleability and reduces the risk of damage to the belt when during packaging, storage, transportation and installation. The packaged belt of the invention facilitates the loading of the photoreceptor by a technician or an untrained customer while preventing damage due to handling (finger prints, scratches, dents, kinks, tears, seam stress) and from ambient light. The photoreceptor belt package configuration also maintains all bends in the photoreceptor belt to bends having a radius of curvature of at least about 9 mm thereby preventing cracking of the photoreceptor layers and severe "set" during long term storage at various temperature extremes.

A number of examples are set forth hereinbelow and are illustrative of different configurations and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A test sample was prepared from a flexible, seamed, multilayered photoreceptor belt material. This material was identical in composition to Xerox 1075 ® Copier/-Duplicator photoreceptor belts, but instead of having a width of 414 mm and a circumference of 1,248 mm, it had a width of 414 mm and a circumference of 1,728 mm. The belt comprised an anti-curl back layer having a thickness of about 14 micrometers, a polyester supporting substrate layer having a thickness of about 75 micrometers, an aluminum conductive ground plane having a thickness of about 300 angstroms, a charge blocking layer having a thickness of about 500 angstroms, an adhesive layer having a thickness of about 600 angstroms, a charge generating layer having a thickness of about 2.4 micrometers and a charge transport layer having a thickness of about 24 micrometers. The anti-curl back layer, substrate layer, adhesive layer, generating layer and transport layer each contained a thermoplastic film forming polymer. The thickness of the entire photoreceptor belt was about 116 micrometers. The belt was packaged with the aid of a first paperboard C-shaped roller having an inside diameter of about 8.9 cm, a second paperboard roller having an outside diameter of about 4.2 cm and a third paperboard roller having an outside diameter of about 4.2 cm. The length of each roller was about 43 mm. The C-shaped roller had a 2.5 cm wide slot extending axially along the length of the roller. The slot width being measured as the straight line distance from one slot edge to the other. The slot edge is the point where the curve of the lip intersected the curve of the C-shaped first roller. This point lies along a line parallel to the axis of the C-shaped first roller. A curved lip for one edge of the slot was prepared from a 3.8 cm wide (measured along the curved surface) strip that was axially cut from a smaller paperboard tube which had a radius of curvature of about 1.2 cm. One long edge of the cutstrip was glued to one edge of the slot of the C-shaped roller to form a curved lip similar to that illustrated in FIGS. 2 and 3. The photoreceptor belt was placed on a table and allowed to flatten under its own weight so that it comprised a flattened middle portion with a small loop at each end. A protective sheet was prepared by overlapping opposite ends of the sheet and securing the overlapped ends with Scotch brand mending tape. The inside circumference of the resulting belt shaped protective cover was substantially identical to the outside circumference of the photoreceptor belt test sample. The protective cover was carefully wrapped around the outside surface of the photoreceptor belt. The second roller was inserted within one end of the belt loop and the third roller was inserted within the other end of the belt loop. The photoreceptor belt and protective sheet were then gently pinched together adjacent the second roller and the C-shaped roller was slid around the second roller and belt loop with the pinched portion of the belt and protective cover sliding into the slot. The lip of the C-shaped roller was positioned above the pinched portion of the belt and protective cover. The C-shaped roller was then rolled toward the third roller while maintaining a slight tension on the belt as it was rolled around the C-shaped roller. Rolling was in a direction which ensured that the pinched portion of the belt was initially wrapped over the lip prior to wrapping around the exterior of the C-shaped roller. After the C-shaped roller was rolled adjacent the third roller, U-shaped plastic clips were inserted over the ends of the rollers to clip the C-shaped roller to the third roller. The assembled belt package was placed into a sealable pouch and the pouch was thereafter sealed.

EXAMPLE II

The photoreceptor belt package described in Example I may be used to install the belt in a suitable electrophotographic printing machine having three photoreceptor belt support rollers mounted on shafts, the end of each shaft being cantilevered from the printing machine frame. The support rollers may be located at the corners of an imaginary triangle having one horizontal side. At least one of the rollers should be movable relative to another roller to apply tension to the belt during the printing operation and to relieve tension on the belt during removal of the belt from the support rollers. The spring biased roller arrangement illustrated in FIG. 1 may be used. After activation of a solenoid to move the spring biased support roller toward the other upper support roller, the old photoreceptor belt may be removed from the electrophotographic printing machine. The ends of the shafts of the upper belt support rollers may be of steel and have a diameter of about 1 inch (2.54 cm). A half inch (1.3 cm) diameter hole having a depth of about 3 inches (7.6 cm) may be drilled into the unsupported ends of the shafts of the upper support rollers. An aluminum support rod having a diameter slightly smaller than the diameter of the drilled holes and having a length of 50 cm may be temporarily inserted into one of the drilled holes. To install a fresh belt such as the belt described in Example I, the wound belt assembly may be removed from the outer pouch and the clips utilized to hold the rollers together may be removed. The second support roller within the interior of the C-shaped roller can thereafter be slid onto the aluminum rod cantilevered from the end of the steel shaft of one of the photoreceptor support rolls of the electrophotographic printing machine. After the second support roller within the C-shaped roller is mounted on the cantilevered aluminum rod, a second cantilevered aluminum rod (identical to the first aluminum rod) can be inserted into the hollow third roller until all but about 18 cm of the rod is enclosed within the third roller. The part of the rod extending from the third roller can be gripped moved away from the C-shaped roller toward the other support roller having a drilled hole. This will unroll the photoreceptor belt from the C-shaped roller and convey the third roller toward the other support roller having a drilled hole. Subsequent to unrolling of the photoreceptor belt, the third support roller may be temporarily supported by aligning the unsupported end of the second aluminum rod with the drilled hole at the end of the shaft of the other photoreceptor support roller and inserting the unsupported end of the second aluminum rod into the drilled hole. The C-shaped roller is thereafter removed from around the second roller by axially sliding the C-shaped roller away from the printing machine. The fresh photoreceptor belt and protective cover sheet may then be slid from the second and third support rollers of the photoreceptor package onto and around the three support rollers of the electrophotographic printing machine. The three photoreceptor package rollers and aluminum rods may thereafter be removed from the electrophotographic printing machine. The protective cover sheet may be removed and the solenoid inactivated to allow the spring biased roller to apply tension to the fresh photoreceptor belt. The installed photoreceptor is expected to be free of finger prints, scratches, dents, kinks, and tears.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A packaged belt comprising a single, thin, flexible electrophotographic belt comprising a photoconductive layer having its outer surface covered with a protective sheet and supported by at least three rollers comprising a hollow first roller having a longitudinal slot parallel to the axis of said first roller which imparts to said first roller a "C" shaped cross section, a lip having an arcuate cross section and a radius of curvature of at least about 9 mm extending from at least one long edge of said slot, a second roller parallel to and enclosed within said first roller, said second roller having an outside diameter smaller than the inside diameter of said first roller and an outside diameter larger than the maximum size of the opening between the lip and the opposite edge of said slot, a third roller adjacent to and parallel to the exterior of said first roller, said belt covered with said protective sheet having at least a partially flattened region with opposite sides of said belt adjacent each other to form a first loop at one end and a second loop at the other end, said first loop extending around said second roller and said second loop extending around said third roller, said belt extending from said second roller, through said slot, and around at least a portion of the outer periphery of said first roller and ending at said third roller.

2. A packaged belt according to claim 1 wherein said belt has a thickness of between about 70 micrometers and about 160 micrometers.

3. A packaged belt according to claim 1 wherein said belt has an outer circumference of at least about 100 cm.

4. A packaged belt according to claim 1 wherein said belt has an outer circumference of at least about 150 cm.

5. A packaged belt according to claim 1 wherein said electrophotographic belt comprises a flexible substrate having an electrically conductive surface, a charge generating layer and a charge transport layer.

6. A packaged belt according to claim 1 wherein said second roller and said third roller have a radius of curvature of at least about 9 mm.

7. A packaged belt according to claim 1 wherein said belt is wrapped around said first roller at least once.

8. A packaged belt according to claim 1 wherein said packaged belt is held together by "U" shaped clips clamping said first roller and said third roller together.

9. A packaged belt according to claim 1 wherein said protective sheet is opaque.

10. A process for packaging a thin, flexible electrophotographic belt comprising providing a single, thin, flexible electrophotographic belt comprising a photoconductive layer having its outer surface covered with a protective sheet, bringing opposite sides of said belt adjacent each other to form at least a partially flattened belt with a first loop at one end and a second loop at the other end, providing a hollow first roller having a longitudinal slot parallel to the axis of the first roller which imparts to said first roller a "C" shaped cross section, said first roller having a lip having an arcuate cross section extending from at least one long edge of said slot, sliding said first loop into the interior of said first roller, with said partially flattened belt sliding through said longitudinal slot, providing a second roller having a diameter that is less than the diameter of said first roller, sliding said second roller into said first loop within said first roller whereby said second roller is enclosed by and coaxial with said first roller, sliding a third roller into said second loop, rotating said first roller to wind said belt around said first roller, supporting the adjacent portion of said protective sheet and said belt during winding with said lip having an arcuate cross section mounted on at least one side of said slot, applying tension to said belt while rotating said first roller, securing said belt, said first roller, said second roller and said third roller together, and maintaining the radius of curvature of at least about 9 mm for any curve or bend in said belt while packaging said electrophotographic belt.

11. A process according to claim 10 including rotating said first roller with a rotatable, cantilevered vacuum platen inserted within said first roller to wind said belt around said first roller.

12. A process according to claim 10 including securing said belt, said first roller, said second roller and said third roller together with "U" shaped clips clamping said first roller and said third roller together.

13. A process for installing a packaged belt into an electrophotographic imaging apparatus comprising providing a packaged, fresh, single, thin, flexible electrophotographic belt comprising a photoconductive layer having its outer surface covered with a protective sheet supported by at least three rollers comprising a hollow first roller having a longitudinal slot parallel to the axis of said first roller which imparts to said first roller a "C" shaped cross section, a lip having an arcuate cross section extending from at least one long edge of said slot, a second roller parallel to and enclosed within said first roller, said second roller having an outside diameter smaller than the inside diameter of said first roller and an outside diameter larger than the maximum size of the opening between the lip and the opposite edge of said slot, a third roller adjacent to and parallel to the exterior of said first roller, said belt covered with said protective sheet having at least a partially flattened region with opposite sides of said belt and protective sheet adjacent each other to form a first loop at one end and a second loop at the other end, said first loop extending around said second roller and said second loop extending around a third roller, said belt extending from said second roller, through said slot, and around at least a portion of the outer periphery of said first roller and ending at said third roller, providing an electrostatographic imaging apparatus comprising at least two photoreceptor belt support rolls, at least one of said photoreceptor belt support rolls being movable relative to the other support roll to apply tension or release tension on a used belt mounted on said support rolls, moving at least one of said support rolls to release tension on said used belt, removing said used belt from said support rolls, temporarily supporting said second roller adjacent one of said support rolls, moving said third roller toward the other support roller to unroll said fresh belt, sliding said fresh belt, protective sheet onto said support rolls, removing said protective sheet moving at least one of said support rolls to apply tension to said fresh belt and maintaining the radius of curvature of at least about 9 mm for any curve or bend in said belt while installing said packaged belt.

14. A process according to claim 13 including braking said second roller while moving said third roller toward the other support roll to unroll said fresh belt.

15. A process according to claim 13 including supporting said second roller adjacent one of said support rolls by providing a shaft cantilevered from the end of said support roll, said shaft extending axially through the interior of said second roller.

16. A process according to claim 13 including supporting said second roller adjacent one of said support rolls by providing a stub shaft cantilevered from the end of said support roll, said stub shaft extending axially into the interior of one end of said second roller.

17. A process according to claim 13 including supporting said third roller adjacent one of said support rolls by providing a shaft cantilevered from the end of said support roll, said shaft extending axially through the interior of said third roller.

18. A process according to claim 13 wherein said fresh belt has an outer circumference of at least about 100 cm.

* * * * *